US008322815B2

(12) United States Patent
Tsukada

(10) Patent No.: US 8,322,815 B2
(45) Date of Patent: Dec. 4, 2012

(54) METHOD OF CLEANING FLUID EJECTING APPARATUS AND FLUID EJECTING APPARATUS

(75) Inventor: Kenji Tsukada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 628 days.

(21) Appl. No.: 12/332,018

(22) Filed: Dec. 10, 2008

(65) Prior Publication Data

US 2009/0147038 A1 Jun. 11, 2009

(30) Foreign Application Priority Data

Dec. 11, 2007 (JP) ..... 2007-319751
Oct. 9, 2008 (JP) ..... 2008-262660

(51) Int. Cl.
*B41J 2/165* (2006.01)
*B41J 29/393* (2006.01)

(52) U.S. Cl. ..... 347/23; 347/19

(58) Field of Classification Search ..... 347/23
See application file for complete search history.

(56) References Cited

U.S. PATENT DOCUMENTS 6,193,355 B1 * 2/2001 Nakamura ..... 347/30
2002/0018092 A1 * 2/2002 Inui et al. ..... 347/23
2003/0058299 A1 * 3/2003 Endo ..... 347/23

FOREIGN PATENT DOCUMENTS

JP 2001-219567 8/2001

* cited by examiner

*Primary Examiner* — Shelby Fidler
(74) *Attorney, Agent, or Firm* — Workman Nydegger

(57) ABSTRACT

Provided is a method of cleaning a fluid ejecting apparatus including an ejection head including a plurality of ejection nozzles for ejecting a fluid to a target and a common fluid chamber from which the fluid is supplied to the ejection nozzles, the method including: performing a preliminary discharge operation for discharging the fluid from the ejection nozzles before the fluid is ejected to the target; detecting a fluid ejection state of the ejection nozzles after the preliminary discharge operation is finished; determining a processing parameter at the time of cleaning of the ejection head on the basis of the detected result; and performing cleaning with respect to the ejection heads on the basis of the processing parameter, wherein, in the performing of the preliminary discharge operation, the fluid of the amount corresponding to at least the volume of the common fluid chamber is ejected.

5 Claims, 10 Drawing Sheets

METHOD OF CLEANING FLUID EJECTING APPARATUS AND FLUID EJECTING APPARATUS

BACKGROUND

1. Technical Field

The present invention relates to a method of cleaning a fluid ejecting apparatus and a fluid ejecting apparatus.

2. Related Art

As a fluid ejecting apparatus, an ink jet printer (hereinafter, referred to as a printer) for ejecting an ink (fluid) from ejecting nozzles of a recording head (ejecting head) onto a recording medium is known. In such a printer, the discharge speed or the discharge amount of the ink from the ejecting nozzles is changed with the elapse of time and thus the discharge state (ejection state) of the ink is changed. Accordingly, in order to maintain the discharge speed or the discharge amount of the ink in a desired range, a process of periodically cleaning the recording head is preformed.

Since bubbles are grown and the ink is thickened in the recording head with the elapse of time, a discharge failure occurs. Accordingly, a printer for performing timer cleaning on the basis of the elapsed time from precedent cleaning or the accumulated print time of the recording head so as to prevent the discharge failure of the ink was suggested (for example, see JP-A-2001-219567). In addition, a printer for checking whether or not a discharge failure occurs and performing cleaning was suggested (for example, see JP-A-2007-021783).

However, if the above-described printer is used, bubbles included in the ink are gradually grown. When a discharge failure test is performed in this state, a normal discharge is detected. However, if a print process of discharging a relatively large amount of ink is performed, bubbles are compressed in a channel by the amount of moving fluid so as to close the channel. Accordingly, a plurality of nozzles is clogged and thus a desired print process cannot be performed.

SUMMARY

An advantage of some aspects of the invention is that it provides a method of cleaning a fluid ejecting apparatus, which is capable of preventing clogging of a plurality of nozzles when a print process is performed, and a fluid ejecting apparatus.

According to an aspect of the invention, there is provided a method of cleaning a fluid ejecting apparatus including an ejection head including a plurality of ejection nozzles for ejecting a fluid to a target and a common fluid chamber to which the fluid is supplied from the ejection nozzles, the method including: performing a preliminary discharge operation for discharging the fluid from the ejection nozzles before the fluid is ejected to the target; detecting a fluid ejection state of the ejection nozzles after the preliminary discharge operation is finished; determining a processing parameter at the time of cleaning of the ejection head on the basis of the detected result; and performing cleaning with respect to the ejection heads on the basis of the processing parameter, wherein, in the performing of the preliminary discharge operation, the fluid of the amount corresponding to at least the volume of the common fluid chamber is ejected.

If the fluid ejecting apparatus is used, bubbles mixed in the fluid are gradually grown. In this case, if a process is performed with a relatively large amount of fluid, the clogging of a plurality of nozzles occurs and thus a printing process may not be suitably performed. Accordingly, if the invention is employed, the fluid (a large amount of fluid) of amount corresponding to at least the volume of the common fluid chamber is ejected from the ejection nozzles by the preliminary discharge operation such that the clogging of the plurality of nozzles can be caused before the printing process. If the clogging of the plurality of nozzles occurs by the preliminary discharge process, the fluid ejection characteristic can be recovered by the cleaning step. Accordingly, since the nozzles which are clogged in advance before the printing process are cleaned, the clogging of the plurality of nozzles does not occur during printing and thus a reliable printing process can be performed.

In the method of cleaning the fluid ejecting apparatus, the detecting of the fluid ejection state may include detecting defective nozzles for causing a fluid ejection failure and the determining of the parameter may include determining the parameter on the basis of the number of defective nozzles.

By this configuration, since the pressure at the time of suction is set as an optimal cleaning process parameter according to the number of defective nozzles, the suction operation can be performed with strength according to the defective nozzles. If the number of defective nozzles is large, it is estimated that the defective nozzles occur due to the bubbles of the channel and thus the pressure at the time of suction is set such that the bubbles are discharged. If the number of defective nozzles is small, it is estimated that the defective nozzles occur due to destroy of a fluid meniscus of the nozzle portion and thus the pressure at the time of the suction is set such that the fluid of the nozzle portion is sucked. Accordingly, it is possible to prevent a problem in which the fluid is excessively sucked from the ejection nozzles and perform a reliable cleaning process.

The method of cleaning the fluid ejecting apparatus may further include determining whether or not the cleaning of the ejection head is performed on the basis of the detected result, between the detecting of the fluid ejection state and the determining of the parameter.

By this configuration, cleaning does not need to be performed if a defective nozzle does not occur. Accordingly, it is possible to prevent a problem in which the fluid is unnecessarily sucked from the ejection nozzles.

In the method of cleaning the fluid ejecting apparatus, in the detecting of the fluid ejection state, a voltage may be applied between a nozzle opening surface of the ejection head in which the ejection nozzles are formed and a fluid reception portion which faces the nozzle opening surface in a non-contact state, the fluid may be ejected from the ejection nozzles to the fluid reception portion, and a nozzle ejection state may be detected by a voltage variation based on electrostatic induction when the fluid is ejected to the fluid reception portion.

By this configuration, it is possible to accurately check the fluid ejection state indicating whether or not the fluid can be suitably ejected from the ejection nozzles. Accordingly, since the parameter of the cleaning process is determined on the basis of the detected result with high precision, it is possible to prevent a problem in which the fluid is excessively sucked from the ejection nozzles at the time of cleaning.

According to another aspect of the invention, there is provided a fluid ejecting apparatus including an ejection head including a plurality of ejection nozzles for ejecting a fluid to a target and a common fluid chamber to which the fluid is supplied from the ejection nozzles, the fluid ejecting apparatus including: a discharge device which performs a preliminary discharge operation for discharging the fluid from the ejection nozzles before the fluid is ejected to the target; a fluid detection unit which detects a fluid ejection state of the ejection nozzles after the preliminary discharge operation is finished and determines a processing parameter when cleaning is performed with respect to the ejection head on the basis of the detected result; and a control device which is electrically connected to the discharge device and the fluid detection unit and performs cleaning with respect to the ejection heads on the basis of the processing parameter, wherein the control device performs the preliminary discharge operation such that the fluid of the amount corresponding to at least the volume of the common fluid chamber is ejected.

If the fluid ejecting apparatus is used, bubbles mixed in the fluid are gradually grown. In this case, if a process is performed with a relatively large amount of fluid, the clogging of a plurality of nozzles is caused and thus a printing process may not be suitably performed. Accordingly, if the invention is employed, the fluid (a large amount of fluid) of amount corresponding to at least the volume of the common fluid chamber is ejected from the ejection nozzles by the preliminary discharge operation such that the clogging of the plurality of nozzles can be caused before the printing process. If the clogging of the plurality of nozzles occurs by the preliminary discharge process, the fluid ejection characteristic can be recovered by the cleaning step. Accordingly, since the nozzles which are clogged in advance before the printing process are cleaned, the clogging of the plurality of nozzles does not occur during printing and thus a reliable printing process can be performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
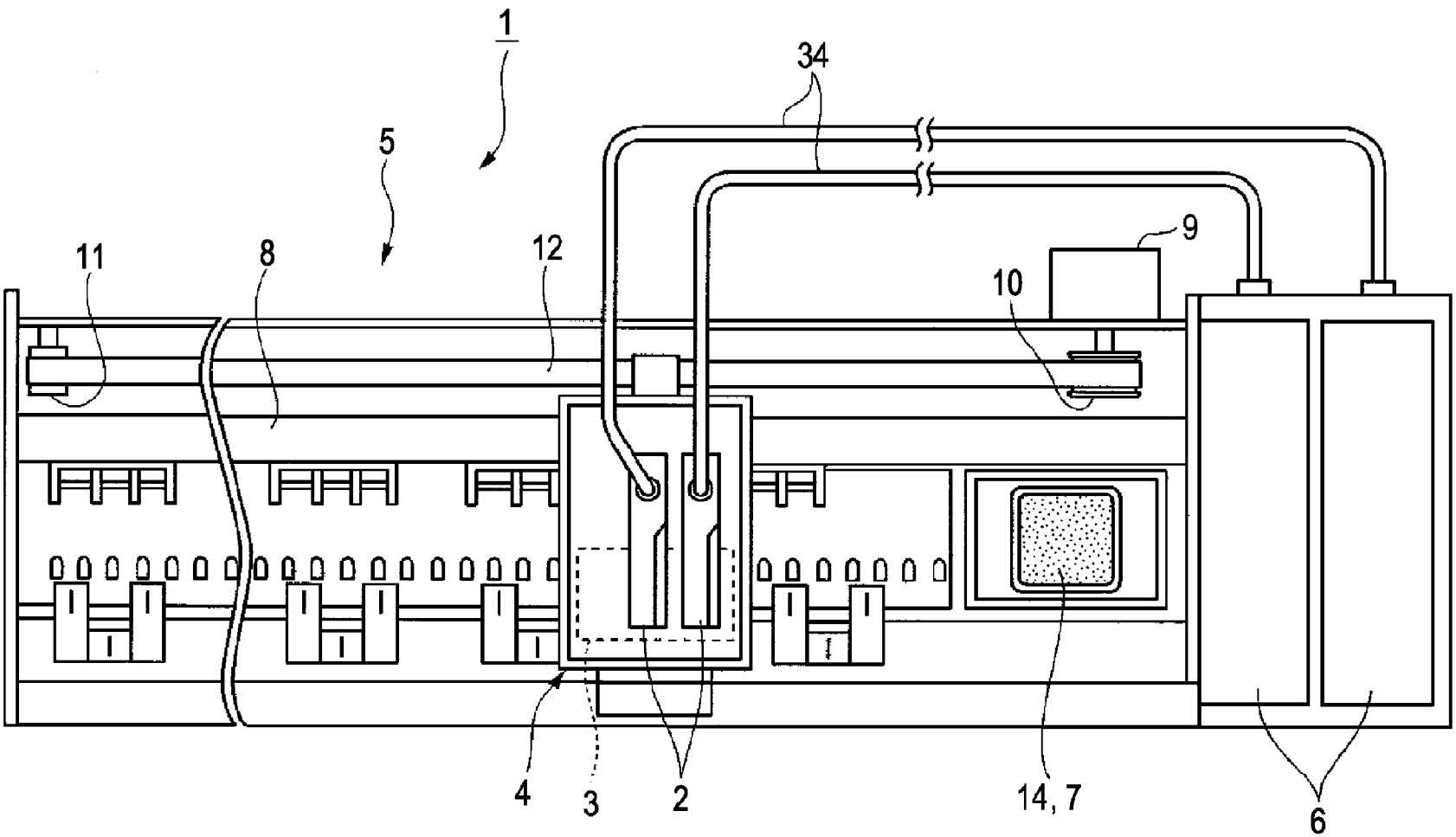
FIG. 1 is a partial exploded view of the schematic configuration of a printer.

Hereinafter, a method of cleaning a fluid ejecting apparatus and a fluid ejecting apparatus according to embodiments of invention will be described with reference to the accompanying drawings. In the present embodiment, an ink jet printer (hereinafter, referred to as a printer 1) is described as a fluid ejecting apparatus of the invention. FIG. 1 is a partial exploded view of the schematic configuration of a printer of an embodiment of the invention.

The printer 1 includes a carriage 4 in which a sub tank 2 and a recording head 3 are mounted and a printer main body 5. In the printer main body 5, a carriage movement mechanism 65 (see FIG. 7) for reciprocally moving the carriage 4, a paper feed mechanism 66 (see FIG. 7) for feeding recording paper (not shown) (fluid ejecting object) a cleaning mechanism 14 as a cleaning mechanism of the recording head (ejecting head) 3 and an ink cartridge 6 for storing an ink supplied to the recording head 3.

Figure 4:
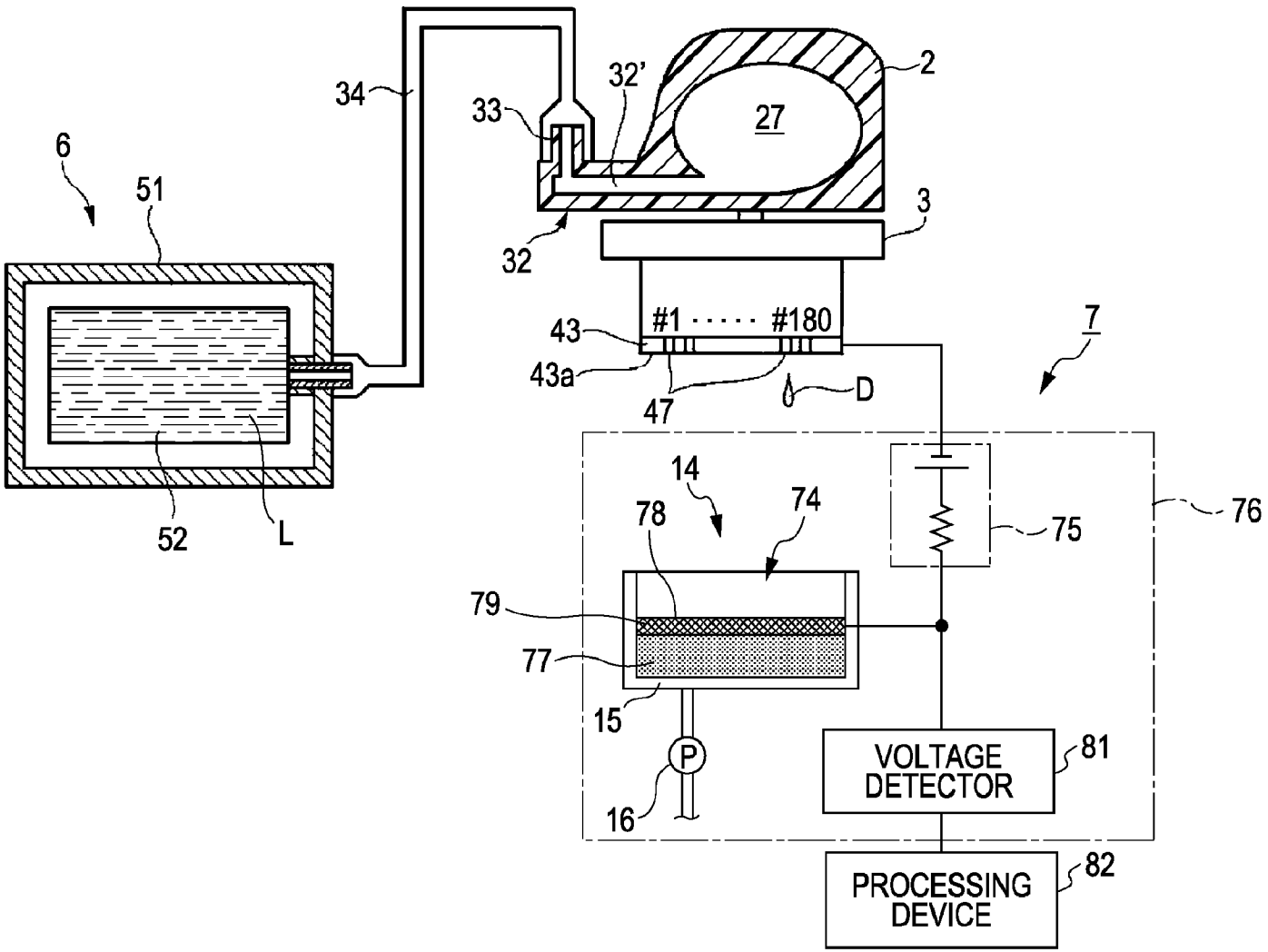
FIG. 4 is a view showing the configuration of the main portion in the periphery of the recording head.
Figure 7:
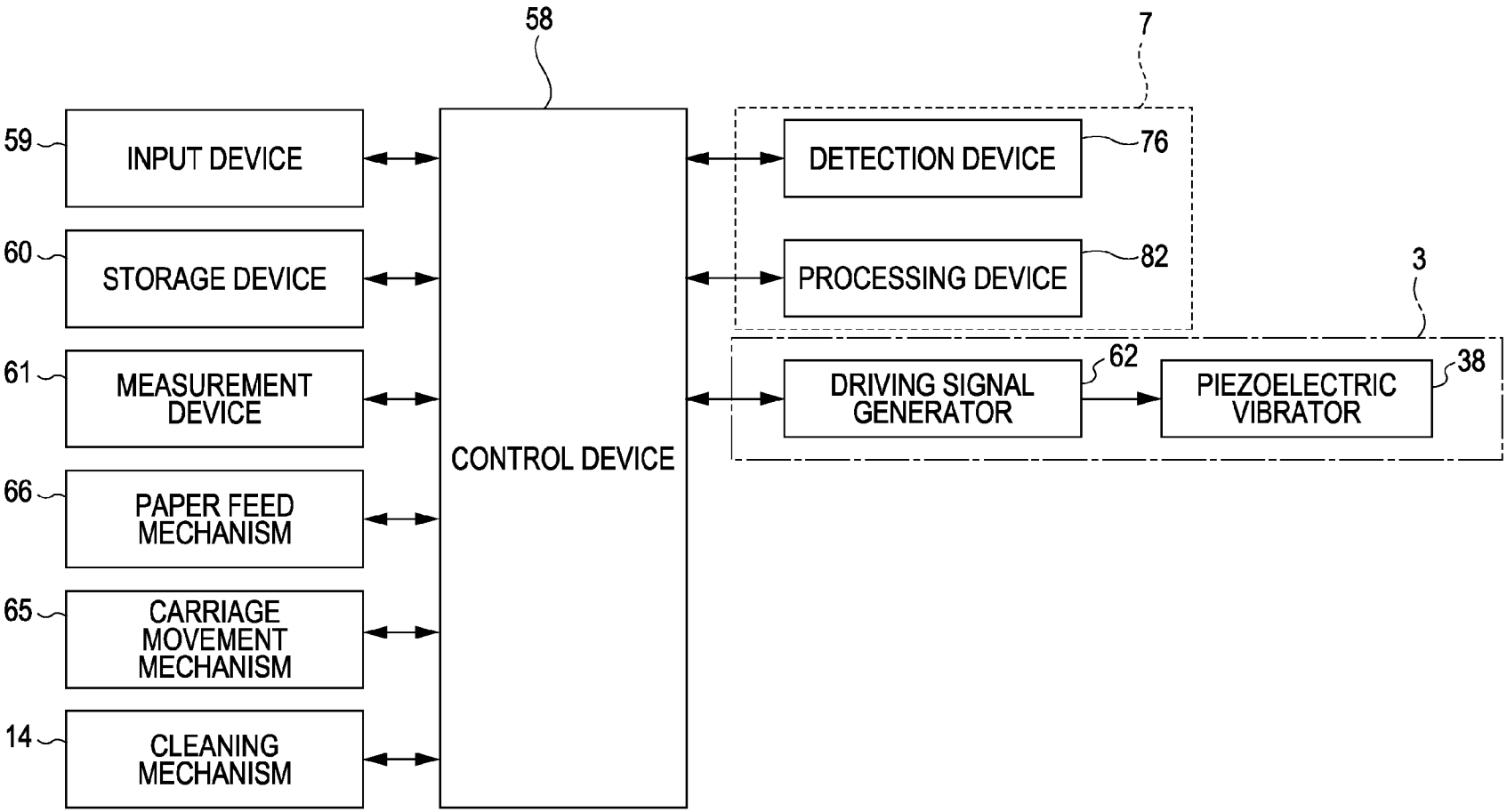
FIG. 7 is a block diagram showing the electrical configuration of the printer.

The printer 1 includes an ink droplet sensor (fluid detecting unit) 7 for detecting ink droplets D discharged from the recording head 3 (see FIGS. 4 and 7). The ink droplet sensor 7 charges the ink droplets D discharged from the nozzles of the recording head 3 and outputs a voltage variation based on electrostatic induction when the discharged ink droplets D fly as a detection signal, thereby detecting an ink discharge state of the nozzles. The details of the ink droplet sensor 7 will be described later.

The carriage movement mechanism 65 includes, as shown in FIG. 1, a guide shaft 8 suspended in the width direction of the printer main body 5, a pulse motor 9, a driving pulley 10 which is connected to a rotation shaft of the pulse motor 9 and is rotated by the pulse motor 9, a free-rolling pulley 11 which is provided at the opposite side of the driving pulley 10 in the width direction of the printer main body 5, and a timing belt 12 stretched between the driving pulley 10 and the free-rolling pulley 11 and connected to the carriage 4.

By driving the pulse motor 9, the carriage 4 is reciprocally moved in a main scan direction along the guide shaft 8. The paper feed mechanism 66 includes a paper feed motor or a paper feed roller (both not shown) rotated by the paper feed motor and sequentially feeds recording paper on a platen in interlock with a recording (printing) operation.

Figure 2:
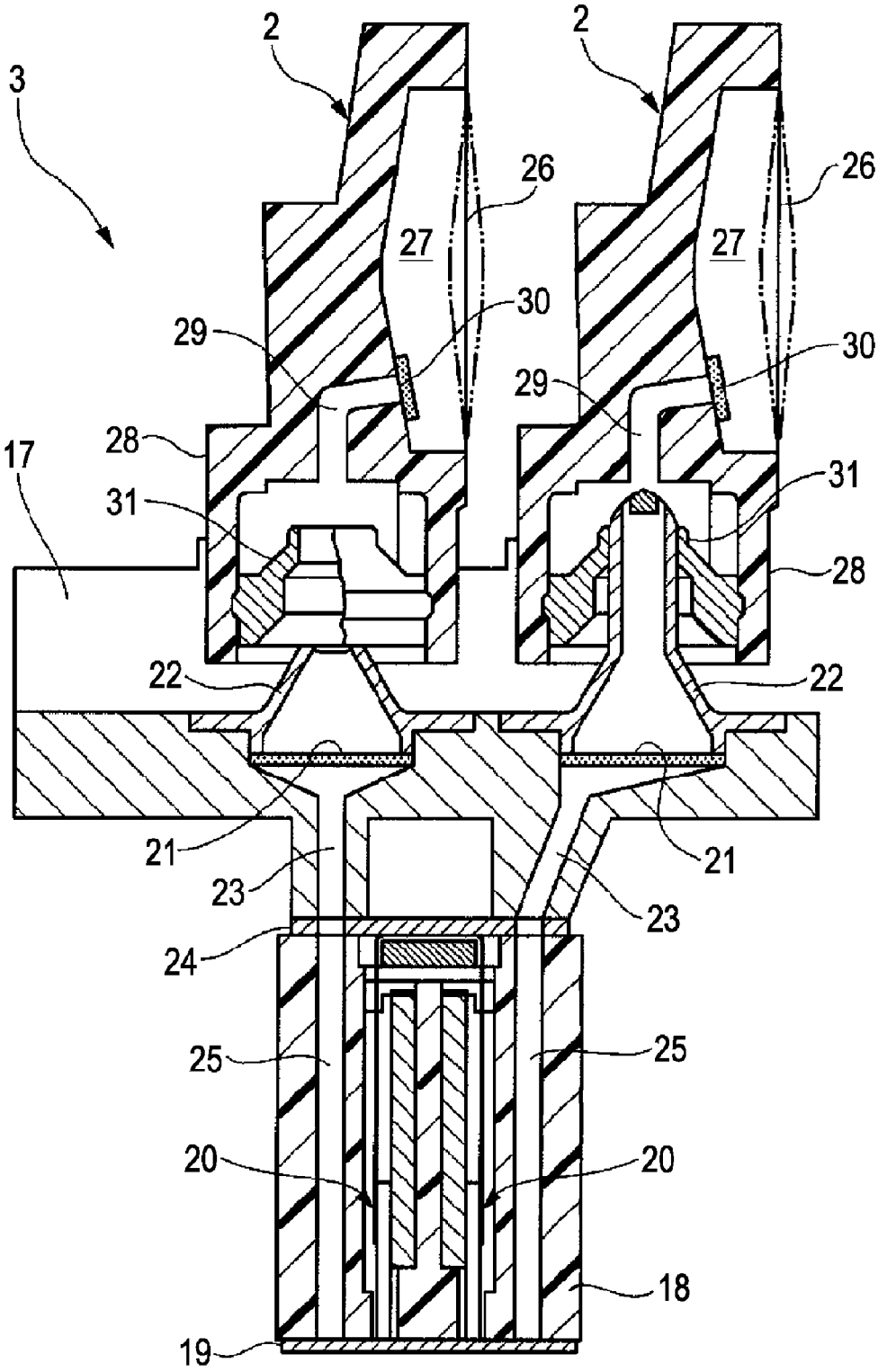
FIG. 2 is a cross-sectional view showing the configuration of a recording head.
Figure 3:
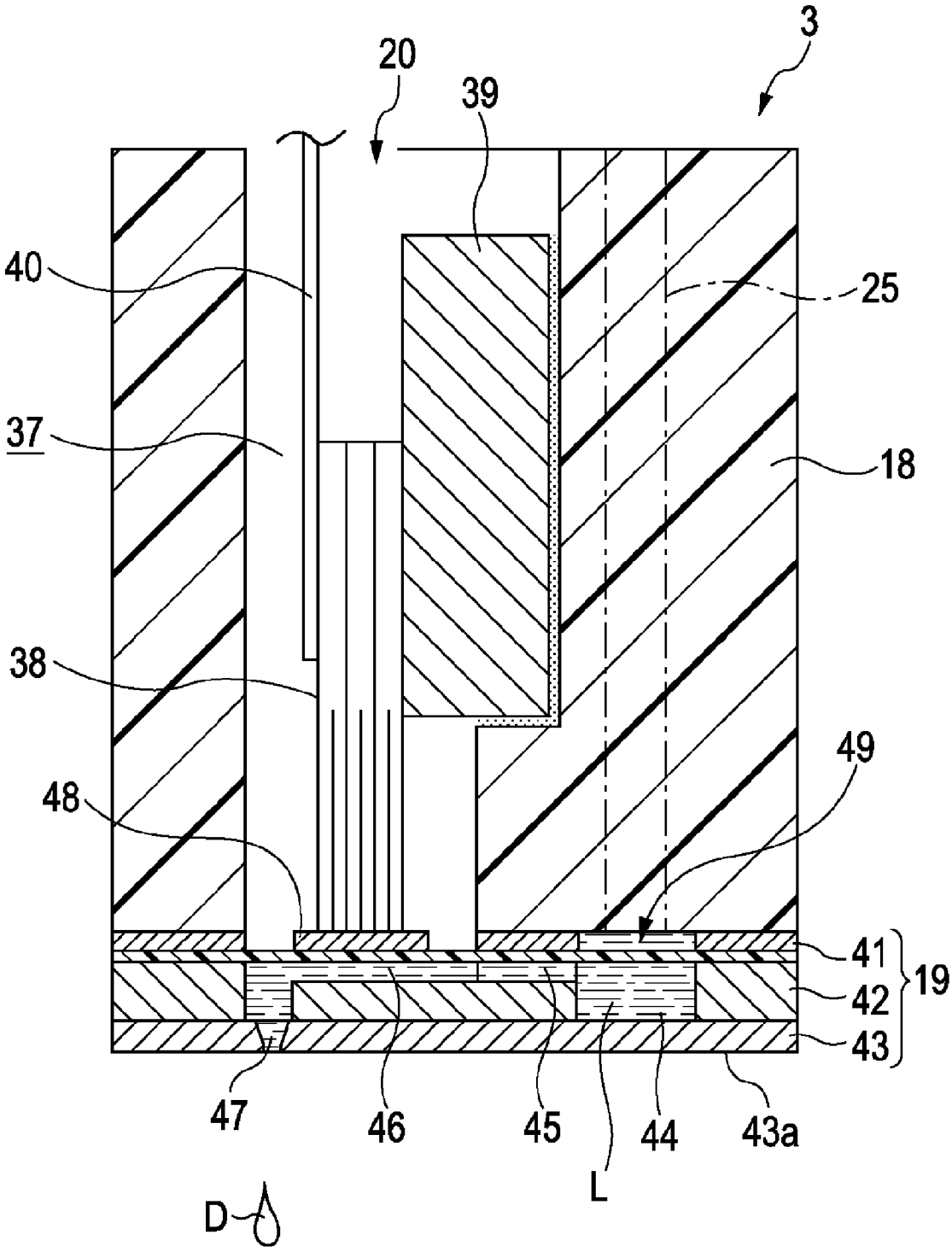
FIG. 3 is a cross-sectional view showing the configuration of the main portion of the recording head.

FIG. 2 is a cross-sectional view showing the configuration of the recording head in the printer. FIG. 3 is a cross-sectional view showing the configuration of the main portion of the recording head. FIG. 4 is a view showing the configuration of the main portion in the periphery of the recording head 3.

As shown in FIG. 2, the recording head 3 of the present embodiment includes an introduction needle unit 17, a head case 18, a channel unit 19 and an actuator unit 20.

Two ink introduction needles 22 are attached in parallel on the upper surface of the introduction needle unit 17, with filters 21 interposed therebetween. Sub tanks 2 are mounted in the ink introduction needles 22, respectively. In the introduction needle unit 17, ink introduction channels 23 corresponding to the ink introduction needles 22 are formed.

The upper ends of the ink introduction channels 23 communicate with the ink introduction needles 22 with the filters 21 interposed therebetween and the lower ends thereof communicate with case channels 25 formed in a head case 18 with a packing 24 interposed therebetween.

Although, in the present embodiment, two inks are used and two sub tanks 2 are arranged, the invention is applicable to the configuration in which at least three inks are used.

The sub tanks 2 are formed of resin such as polypropylene. In each of the sub tanks 2, a concave portion which becomes an ink chamber 27 is formed and a transparent elastic sheet 26 is attached to an opening of the concave portion so as to partition the ink chamber 27.

On the lower side of each of the sub tanks 2, a needle connection portion 28 into which each of the ink introduction needles 22 is inserted protrudes downward. The ink chamber 27 of each of the sub tanks 2 having a shallow truncated cone shape and faces an upstream opening of a connection channel 29 communicating with the needle connection portion 28 at a position which is slightly lower than the center of top and bottom of the side surface thereof. A tank filter 30 for filtering inks L is attached on the upstream opening. A seal member 31 into which each of the ink introduction needles 22 is light-tightly fitted is inserted in the inner space of the needle connection portion 28.

As shown in FIG. 4, an extension portion 32 having a communication groove 32' communicating with the ink chamber 27 is formed in each of the sub tanks 2 and an ink lead-in port 33 protrudes on the upper surface of the extension 32. An ink supply tube 34 for supplying the inks L stored in the ink cartridge 6 is connected to the ink lead-in port 33. Accordingly, the inks L passing through the ink supply tube 34 flow from the ink lead-in port 33 to the ink chamber 27 through the communication groove 32'.

The elastic sheet 26 shown in FIG. 2 may be deformed in direction contracting and expanding the ink chamber 27. By a damper function due to the deformation of the elastic sheet 26, a variation in pressure of the inks L is absorbed. The sub tanks 2 function as a pressure damper by the operation of the elastic sheet 26. Accordingly, the inks L are supplied to the recording head 3 in a state in which the variation in pressure is absorbed in the sub tanks 2.

The head case 18 is a hollow-box-shaped member made of synthetic resin, of which the lower end surface is attached with a channel unit 19, a reception space 37 formed therein receives an actuator unit 20, and the upper end surface of the opposite side of the channel unit 19 is attached with the introduction needle unit 17 with a packing 24 interposed therebetween.

Case channels 25 are provided in the head case 18 in the height direction. The upper ends of the case channels 25 communicate with the ink introduction channels 23 of the introduction needle unit 17 via the packing 24.

The lower ends of the case channels 25 communicate with a common ink chamber 44 of the channel unit 19. Accordingly, the inks L introduced from the ink introduction needles 22 are supplied to the common ink chamber 44 through the ink introduction channels 23 and the case channels 25.

The actuator unit 20 received in the reception space 37 of the head case 18 includes, as shown in FIG. 3, a plurality of piezoelectric vibrators 38 arranged in a comb shape, a fixed plate 39 adhered with the piezoelectric vibrators 38, and a flexible cable 40 as a wire member for supplying a driving signal from the printer main body to the piezoelectric vibrators 38. The fixed ends of the piezoelectric vibrators 38 are adhered to the fixed plate 39 and the free ends thereof are protruded than the front end surface of the fixed plate 39 outward. That is, the piezoelectric vibrators 38 are attached on the fixed plate 39 in a cantilever state.

The fixed plate 39 for supporting the piezoelectric vibrators 38 is formed of stainless steel having a thickness of 1 mm. The actuator unit 20 is received and fixed in the reception space 37 by adhering the rear surface of the fixed plate 39 to the case inner wall partitioning the reception space 37.

The channel unit 19 is manufactured by adhering a channel unit configuring member including a vibration plate (sealing plate) 41, a channel substrate 42 and a nozzle substrate 43 by an adhesive in a lamination state and is a member forming a series of ink channels (liquid channels) from the common ink chamber 44 to the nozzles 47 through ink supply ports 45 and pressure chambers 46. The pressure chamber 46 is formed as a chamber elongated in a direction orthogonal to the arrangement direction (nozzle array direction) of the nozzles 47. The common ink chamber 44 is a chamber which communicates with the case channel 25 and into which the inks L are introduced from the ink introduction needles 22.

The inks L introduced into the common ink chamber 44 are distributed to pressure chambers 46 through the ink supply ports 45.

The cleaning mechanism 14 includes, as shown in FIG. 4, a cap member 15 and a suction pump 16. The cap member 15 is constituted by a member obtained by molding an elastic material such as rubber in a tray shape and is arranged at a home position. This home position is set in an outer end region of a recording region in the movement range of the carriage 4 and is a place where the carriage 4 is positioned when a flushing operation for recovering or maintaining election characteristics by discharging the inks from the nozzles 47 of the recording head 3 is performed or a flushing process for discharging the ink droplets D is performed in order to discharge the inks L or bubbles before or during the recording operation of the recording head 3.

In the cap member 15, the carriage 4 is positioned at the home position at the time of the cleaning process of the recording head 3. At this time, the process is performed in a state in which the cap member 15 is sealed in contact with the surface (that is, the nozzle opening surface 43*a*) of the nozzle substrate 43 of the recording head 3. The cleaning process indicates a process of operating the suction pump in the sealed state, depressurizing the inside of the cap member 15, and forcibly discharging the inks L in the recording head 3 from the nozzles 47.

The printer 1 according to the present embodiment is used for business purpose (for example, document preparation).

The inks L stored in the ink cartridge 6 are supplied to the ink introduction needles 22 through the ink supply tube 34 as described above. If air is introduced at the time of exchange of the ink cartridge 6, bubbles are floated in the inks L supplied to the ink introduction needles 22. If the inks which are not defoamed are used, bubbles are dissolved in the inks.

If the printer 1 is used for a long period of time, the dissolved bubbles are grown to bubbles and the floated bubbles are further grown. Since the bubbles are supplied to the recording head, a discharge failure occurs. Thus, the filter 21 shown in FIG. 2 prevents the passage of the bubbles. The filter 21 has a mesh shape such that liquid is passed and large bubbles are not passed. The filter is used as a resistance of the channel. If bubbles exist in the filter, the area of the channel is reduced. Accordingly, the sectional area of a chamber in which the filter is arranged is larger than that of other channels such that the resistance of the channel is prevented from being increased due to the bubbles or the filter. Thus, even when bubbles exist in the filter, the ink flows in the peripheries of the bubbles. If the discharge having a high duty is performed (the discharge amount is large), the bubbles adhered to the filter 21 are compressed by the flow of the inks so as to close the filter such that the inks L cannot be supplied from the ink introduction channels 23 to the common ink chamber 44 of the channel unit 19 through the case channels 25. Then, the inks L cannot be supplied from the common ink chamber 44 to the pressure chambers 46 through the ink supply ports 45 and, as a result, the inks may not be discharged from the plurality of nozzles 47, that is, the plurality of nozzles may be clogged.

In the present embodiment, if the printing operation is performed in the printer 1 which is maintained in a standby state for a long period of time, a flushing device (discharge device) for performing a preliminary flushing operation (preliminary discharge operation) for discharging the inks from the nozzles 47 before the printing process of the printer 1, the cap member 15 is included. The printer 1 includes the ink droplet sensor 7 as a detection device for detecting an ink ejection state of the nozzles 47 after the preliminary flushing operation and determining a processing parameter at the time of the cleaning operation of the recording head 3 on the basis of the detected result. The printer 1 includes a control device 58 for operating the cleaning mechanism 14 and performing the cleaning process of the recording head 3 on the basis of the processing parameter, such that the cleaning process is performed.

That is, the printer 1 according to the present embodiment performs the cleaning operation including a preliminary flushing step of performing a preliminary flushing operation for discharging the inks from the nozzles 47 before the printing process of the recording head 3 which is in the standby state for a long period of time, a detecting step of detecting an ink ejection state of the nozzles 47 after the preliminary flushing step is finished, a test step of determining the processing parameter at the time of the cleaning process of the recording head 3, and a cleaning step of cleaning the recording head 3 on the basis of the processing parameter.

The control device 58 ejects the inks of amount corresponding to the volume of the common ink chamber (common fluid chamber) 44 in the preliminary flushing process. In the related art, if the preliminary flushing process is performed by discharging just a few ink droplets from the nozzle, the ink ejection state was detected. However, the bubbles adhered to the filter cannot be compressed by the several ink droplets because the inks do not rapidly flow and a time is short. Accordingly, in the existing preliminary flushing process, although the bubbles can clog a plurality of nozzles when large amounts of ink droplets are discharged during the printing operation may exist, the bubbles cannot be detected. In the related art, not only was the discharge failure detected, but also the growth of bubbles was estimated by the time elapsed from a precedent cleaning process, and the cleaning process was performed at a time when the bubbles is increased in size. However, the growth of the bubbles can change according to the ambient temperature or the number of times of exchange of the ink cartridge 6. Accordingly, since the cleaning process is performed even when the size of the bubbles is not large enough for clogging the plurality of nozzles, a larger amount of ink was consumed. In the related art, since a large amount of ink is discharged from the nozzles 47 by the preliminary flushing process, it is possible to cause the clogging of the plurality of nozzles before the printing process. Since the bubbles need to be compressed by the flow of the inks in order to cause the clogging of the plurality of nozzles, a necessary amount of ink is shed. The existing flushing for suppressing the thickening of the inks in the nozzles cannot crush the bubbles even if the inks are discharged from all the nozzles, because only the amount of inks in the nozzle openings are discharged and the inks are discharged from the nozzles for only a short period of time. The same is true in the flushing for detecting the discharge failure. Therefore, an amount of inks which corresponds to at least the volume of the common ink chamber (common fluid chamber) 44 needs to be shed as the amount shed during a period sufficient for clogging by bursting the bubbles in the filter. Since the amount of inks correspond to at least the volume of the common ink chamber, the amount of inks may be greater than the volume of the common ink chamber, for example, may correspond to the volume from the nozzles to the common ink chamber 44, the volume from the filter 21 to the ink introduction needles 22 or the volume from the common ink chamber 44 to the filter 21. Since shedding of a large amount of inks will suffice, the inks do not need to be discharged from all the nozzles. Since the large amount of inks can be discharged from the nozzles 47, the inks may flow by suction or pressurization instead of the flushing. The preliminary flushing operation, the suction or the pressurization corresponds to a preliminary ejection operation. If the clogging of the plurality of nozzles is caused by the preliminary flushing process, the discharge characteristics of the recording head 3 can be recovered by the cleaning process of the cleaning mechanism 14. Accordingly, even when the printing process is performed by the printer 1 in which the bubbles are grown due to the use of a long period of time, it is possible to prevent the plurality of nozzles from being clogged during the printing operation and improving the reliability of the printer 1.

If the clogging of the plurality of nozzles is not caused by the preliminary flushing process, the cleaning process is not performed. When bubbles are grown during the printing operation and high duty printing using a relatively large amount of inks is performed, there is no point in causing the clogging of the plurality of nozzles. Accordingly, the amount of inks flowing by the preliminary flushing process is greater than the amount of inks flowing in the high duty printing in the printing operation such that the clogging of the plurality of nozzles is prevented although the bubbles are grown during the printing operation. The amount of inks is set depending on the frequency of the preliminary flushing process. For example, if the printer is operated from morning to night, the amount of bubbles grown in one day is estimated. However, if the preliminary flushing process is performed every day, the amount of inks consumed is increased and thus the amount of inks used in the printing is decreased. If the preliminary flushing operation is performed using a timer every week and the amount of inks is set by estimating the amount of bubbles grown for one week, the preliminary flushing operation is performed once every week and thus the amount of inks consumed can be decreased. The growth of bubbles for one day is a very small amount and at least one week is necessary in order to obtain a difference as the ink amount with certainty. When the preliminary flushing process is not performed before the printing process, the discharge test may be performed by the existing flushing using several ink droplets in order to check whether or not the discharge failure occurs due to the cause except the bubbles.

The nozzle substrate 43 arranged on the bottom of the channel unit 19 is a thin plate which is made of metal and in which the plurality of nozzles 47 are arranged in a row with a pitch (for example, 180 dpi) corresponding to a dot forming density. The nozzle substrate 43 of the present embodiment is made of a stainless steel plate and, in the present embodiment, a total of eight arrays of nozzles 47 (that is, nozzle arrays) are arranged in correspondence with the sub tanks 2. One nozzle array is, for example, constituted by 180 nozzles 47. The channel substrate 42 interposed between the nozzle substrate 43 and the vibration plate 41 is a plate-shaped member in which the channel units which become the ink channels, that is, the common ink chamber 44, the ink supply ports 45 and the pressure chambers 46 are formed.

In the present embodiment, the channel substrate 42 is manufactured by anisotropic etching a silicon wafer having crystallinity. The vibration plate 41 is a composite plate having a double structure by laminating an elastic film on a support plate made of metal such as stainless steel. At a portion corresponding to each of the pressure chambers 46 of the vibration plate 41, an island portion 48 attached with the front end surface of the piezoelectric vibrator 38 is formed by removing the support plate in an annular shape by etching and functions as a diaphragm. That is, the vibration plate 41 is configured such that an elastic film at the periphery of the island portion 48 is deformed by the piezoelectric vibrator 38. The vibration plate 41 seals opening surface of one side of the channel substrate 42 and functions as a compliance portion 49. A portion corresponding to the compliance portion 49 is formed of only the elastic film by removing the support plate by etching similar to the diaphragm.

In the recording head 3, when a driving signal is supplied to the piezoelectric vibrator 38 via the flexible cable 40, the piezoelectric vibrator 38 extends and contracts in the longitudinal direction of the element and thus the island portion 48 moves in a direction which approaches or separates from each of the pressure chambers 46. Accordingly, the volumes of the pressure chambers 46 are changed and thus the pressure variation occurs in the inks L in the pressure chambers 46. By the pressure variation, the ink droplets D are discharged from the nozzles 47.

As shown in FIG. 4, the ink cartridge 6 includes a case member 51 formed in a hollow box shape and an ink pack 52 formed of a plastic material. The ink pack 52 is received in a reception chamber of the case member 51.

The ink cartridge 6 communicates with one end of the ink supply tube 34 and supplies the inks L in the ink pack 52 to the recording head 3 by a waterhead difference with the nozzle opening surface 43*a* of the recording head 3. In more detail, a relative positional relationship between the ink cartridge 6 and the recording head 3 in a gravity direction is set such that very slight negative pressure is applied to the meniscus of the nozzles 47.

By the pressure variation due to the driving of the piezoelectric vibrator 38, the inks L are supplied to the pressure chambers 46 and the ink droplets D are discharged from the pressure chambers 46 as described above.

Ink Droplet Sensor 7

Subsequently, the configuration of the ink droplet sensor 7 will be described in detail. The ink droplet sensor 7 includes, as shown in FIG. 4, a detection device 76 which is disposed so as to face the nozzle opening surface 43*a* of the recording head 3 at a predetermined gap, has a detection unit 78 to which the inks discharged from the nozzles 47 are supplied, outputs detection waveforms according to the inks discharged from the nozzles 47, and detects the ink discharge state of the nozzles 47, and a processing device 82 for acquiring information the gravities of the inks on the basis of the detection waveforms output from the detection device 76. The processing device 82 has a function for determining the parameter of the cleaning process on the basis of the detected results of the detection device 76.

The detection device 76 includes a voltage applying unit 75 for applying a voltage between the detection unit 78 and the nozzle opening surface 43*a* of the recording head 3 and a voltage detector 81 for detecting the voltage of the detection unit 78. In the present embodiment, the detection unit 78 of the detection device 76 is provided in the cap member disposed at the home position as described above.

The cap member 15 is a tray-shaped member of which the upper surface is opened and is formed of an elastic member such as elastomer. In the cap member 15, an ink absorber 77 and an electrode member 79 are disposed. The electrode member 79 is formed of a mesh member of metal such as stainless steel. The detection unit 78 is formed by the upper surface of the electrode member 79. The detection unit 78 is disposed at a position lower than that of the upper end surface of the cap member 15.

The ink absorber 77 suppresses the dry of the inks in the nozzles 47 by allowing the inks absorbed in the ink absorber 77 to keep wet the interior of the space formed by bringing the cap member 15 and the nozzle opening surface 43*a* into contact with each other, for example, during non-recording.

The ink droplets D impacting the detection unit 78 pass through the gap of the electrode member 79 having a lattice shape and are held (absorbed) in the ink absorber 77 disposed on the lower side. If the ink droplets D are passed, the electrode member 79 may not be a mesh member. If the ink absorber 77 is not included, the electrode member 79 is held by a rib extending from the lower surface of the cap member 15. As described above, a tube (not shown) is connected to the bottom of the cap member 15 such that the ink droplets D of the ink absorber 77 pass through the tube, are sucked by the suction pump 16, and are discharged.

A voltage applying unit 75 includes an electronic circuit for applying a voltage between the ejection surface (nozzle opening surface 43*a*) of the nozzle substrate 43 of the recording head 3 and the detection unit (upper surface) 78 of the electrode member 79. In the present embodiment, the voltage applying unit 75 is electrically connected to the electrode member 79 and the nozzle substrate 43 via a power source and a resistor such that the electrode member 79 becomes a positive electrode and the nozzle substrate 43 becomes a negative electrode.

As described above, the nozzle substrate 43 is formed of metal such as stainless steel and the electrode member 79 is formed of metal such as stainless steel. The nozzle substrate 43 and the electrode member 79 have conductivity. That is, the voltage applying unit 75 applies the voltage between the nozzle opening surface 43*a* and the detection unit 78.

A voltage detector 81 includes an integrating circuit for integrating the voltage signal of the electrode member 79 and outputting the integrated signal, an inversion amplifier circuit for inversely amplifying the signal output from the integrating circuit and outputting the amplified signal, and an A/D conversion circuit for A/D-converting the signal output from the inversion amplifier circuit and outputting the converted signal.

In the present embodiment, a detection device 76 applies a voltage between the nozzle opening surface 43*a* and the detection unit 78 and outputs a temporal variation of a voltage value based on electrostatic induction when the inks move from the nozzles 47 to the detection unit 78 to a processing device 82 as a detection waveform. The processing device 82 can arithmetically operate the output of the detection device 76 and acquire information about the weights of the inks on the basis of the detection waveform output from the detection device 76.

Figure 5A:
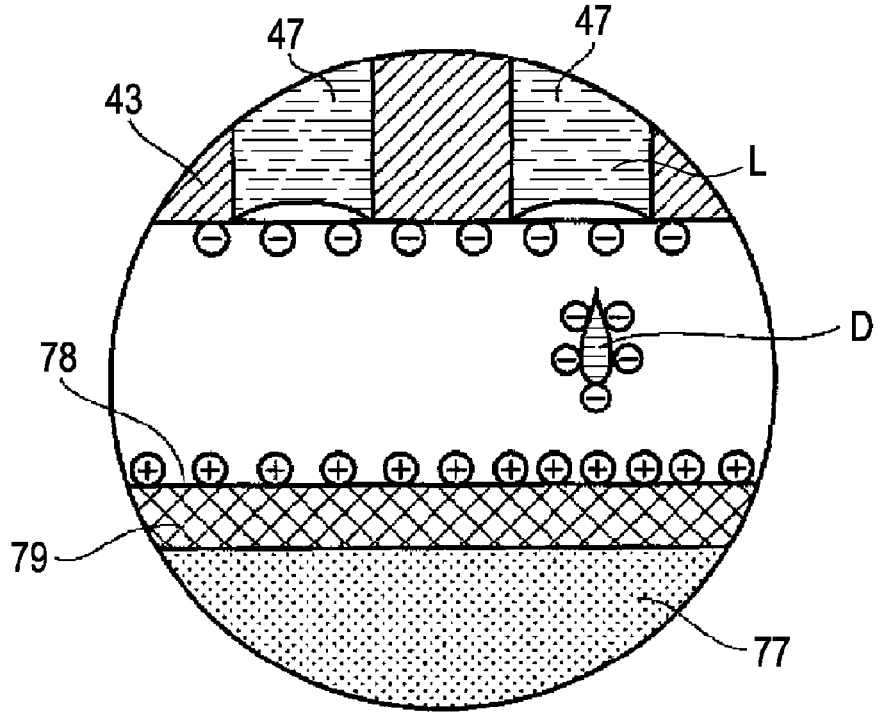
FIGS. 5*a* and 5*b* are views showing the principle that an induced voltage is generated by electrostatic induction.
Figure 5B:
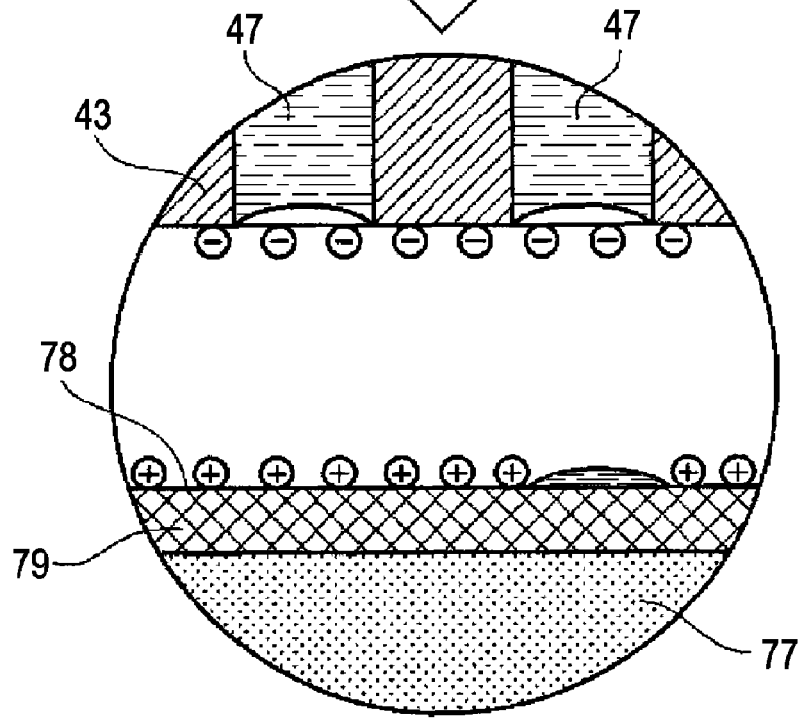
Figure 6:
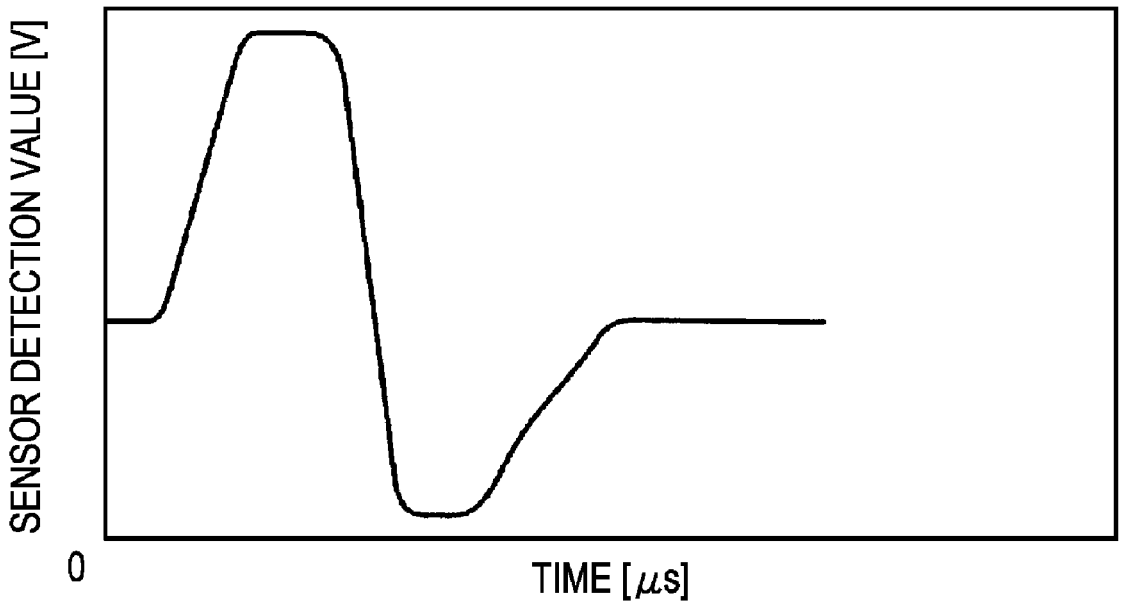
FIG. 6 is a view showing an example of the waveform of a detection signal output from an ink droplet sensor.

Hereinafter, the principle of the ink droplet sensor 7, that is, the principle that an induced voltage is generated by the electrostatic induction, will be described with reference to the drawings. FIG. 5 is a view showing the principle that an induced voltage is generated by electrostatic induction, wherein FIG. 5A shows a state immediately after the ink droplets D are discharged and FIG. 5B shows a state in which the ink droplets D impact an inspection region 74 of the cap member 15. FIG. 6 is a view showing an example of the waveform of a detection signal (one ink droplet) output from the ink droplet sensor 7. In a state in which the voltage is applied between the nozzle substrate 43 and the electrode member 79, the piezoelectric vibrator 38 is driven using a discharge pulse DP such that the ink droplet D is discharged from one of the nozzles 47.

At this time, since the nozzle substrate 43 are the negative electrode, as shown in FIG. 5A, negative charges of a portion of the nozzle substrate 43 move to the ink droplet D such that the discharged ink droplet D is charged by a negative polarity. As the ink droplet D approaches the detection unit 78 of the cap member 15, positive charges are increased on the surface of the electrode member 79 by the electrostatic induction.

Accordingly, the voltage between the nozzle substrate 43 and the electrode member 79 becomes higher than an initial voltage in a state in which the ink droplet D is not discharged, by the induced voltage generated by the electrostatic induction.

Thereafter, as shown in FIG. 5B, if the ink droplet D impacts the electrode member 79, the positive charges of the electrode member 79 are neutralized by the negative charges of the ink droplet D. Accordingly, the voltage between the nozzle substrate 43 and the electrode member 79 is lower than the initial voltage.

Thereafter, the voltage between the nozzle substrate 43 and the electrode member 79 is returned to the initial voltage.

Accordingly, as shown in FIG. 6, the detection waveform output from the ink droplet sensor 7 becomes a waveform in which the voltage is increased, is decreased so as to be lower than the initial voltage, and is returned to the initial voltage.

Accordingly, the voltage variation when the ink droplet D is discharged from each of the nozzles 47 is detected by the ink droplet sensor 7.

If, for example, clogging of nozzles occurs, although the same discharge pulse DP is used, the ink droplets D are not impacted and thus the waveform cannot be obtained. Accordingly, it is possible to detect the nozzles 47 which are clogged.

The ink droplet sensor 7 allows the processing device 82 to decide a cleaning parameter on the basis of the detected result. In the present embodiment, the driving condition of the suction pump 16 in the suction operation at the time of cleaning is used as the cleaning parameter.

By using the ink droplet sensor 7, it is possible to accurately check an ink discharge state indicating whether or not the inks can be discharged from the nozzles 47, by discharging the inks from the nozzles 47 one droplet by one droplet. Accordingly, since the processing parameter at the time of cleaning can be determined on the basis of the detected result with high precision, it is possible to prevent a problem in which the inks are excessively sucked from the nozzles 47 at the time of cleaning. Several ink droplets may be discharged, instead of one ink droplet.

FIG. 7 is a block diagram showing the electrical configuration of the printer 1. The printer 1 of the present embodiment includes a control device 58 for controlling the whole operation of the printer 1. The control device 58 is connected with an input device 59 for inputting a variety of information about the operation of the printer 1, a storage device 60 for storing the variety of information about the operation of the printer 1, and a measurement device 61 for performing the measurement of a time.

The control device 58 is connected with the paper feed mechanism 66, the carriage movement mechanism 65, the cleaning mechanism 14, and the ink droplet sensor 7 (the detection device 76 and the processing device 82).

The printer 1 includes a driving signal generator 62 for generating the driving signal input to the piezoelectric vibrator 38. The driving signal generator 62 is connected to the control device 58.

By the above-described configuration, the printer 1 stores the cleaning parameter decided by the processing device 82 on the basis of the detected result of the detection device 76 of the ink droplet sensor 7 in the storage device 60. The printer 1 drives the suction pump 16 on the basis of the cleaning parameter read from the storage device 60 so as to perform a cleaning process. Accordingly, the printer 1 sucks and forcibly discharge thickened inks L or bubbles from the nozzles 47 of the recording head 3 into the cap member 15 such that the ejection characteristic of the recording head 3 is recovered.

Figure 9:
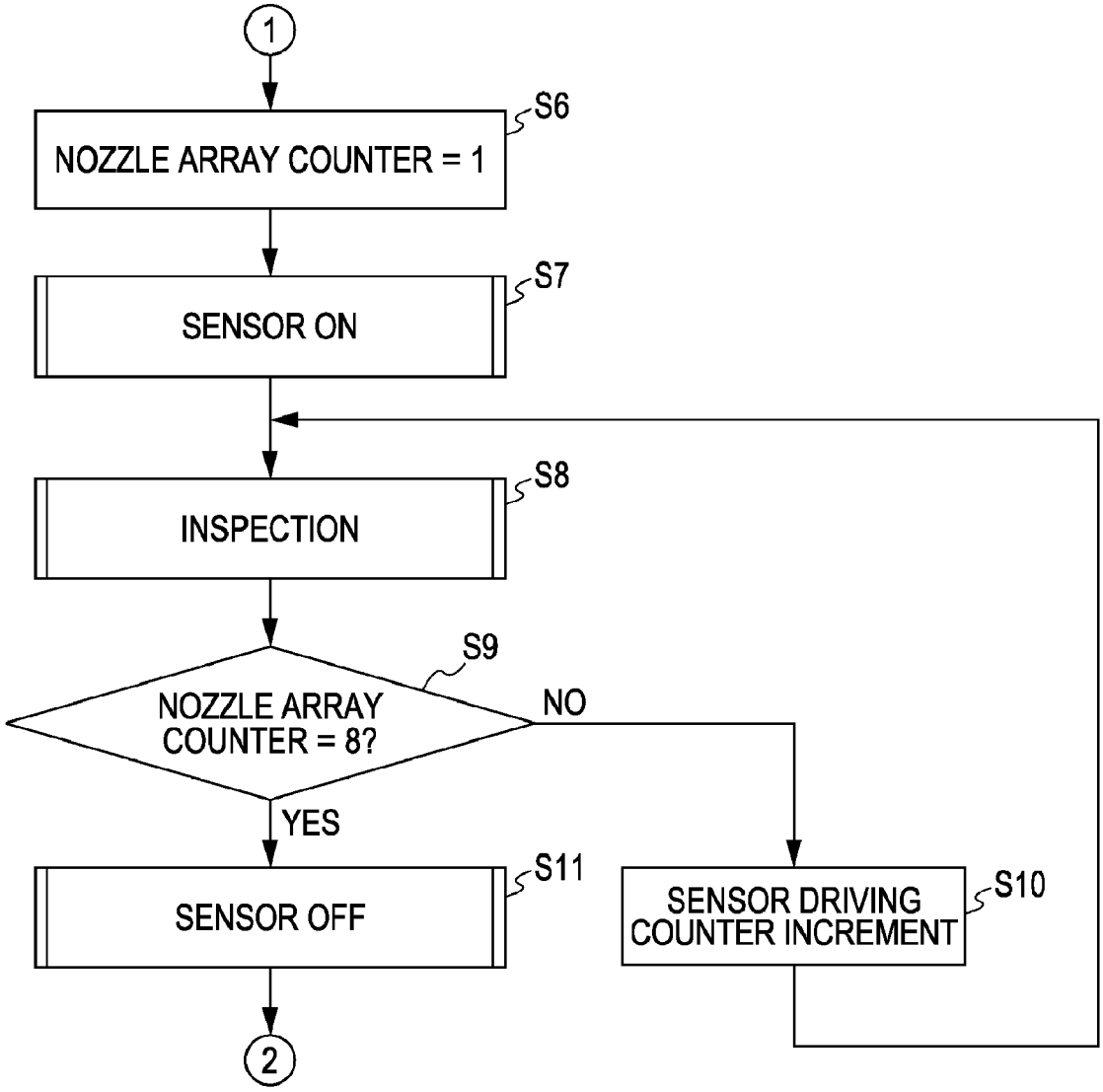
FIG. 9 is a view showing the cleaning process subsequent to FIG. 8.
Figure 10:
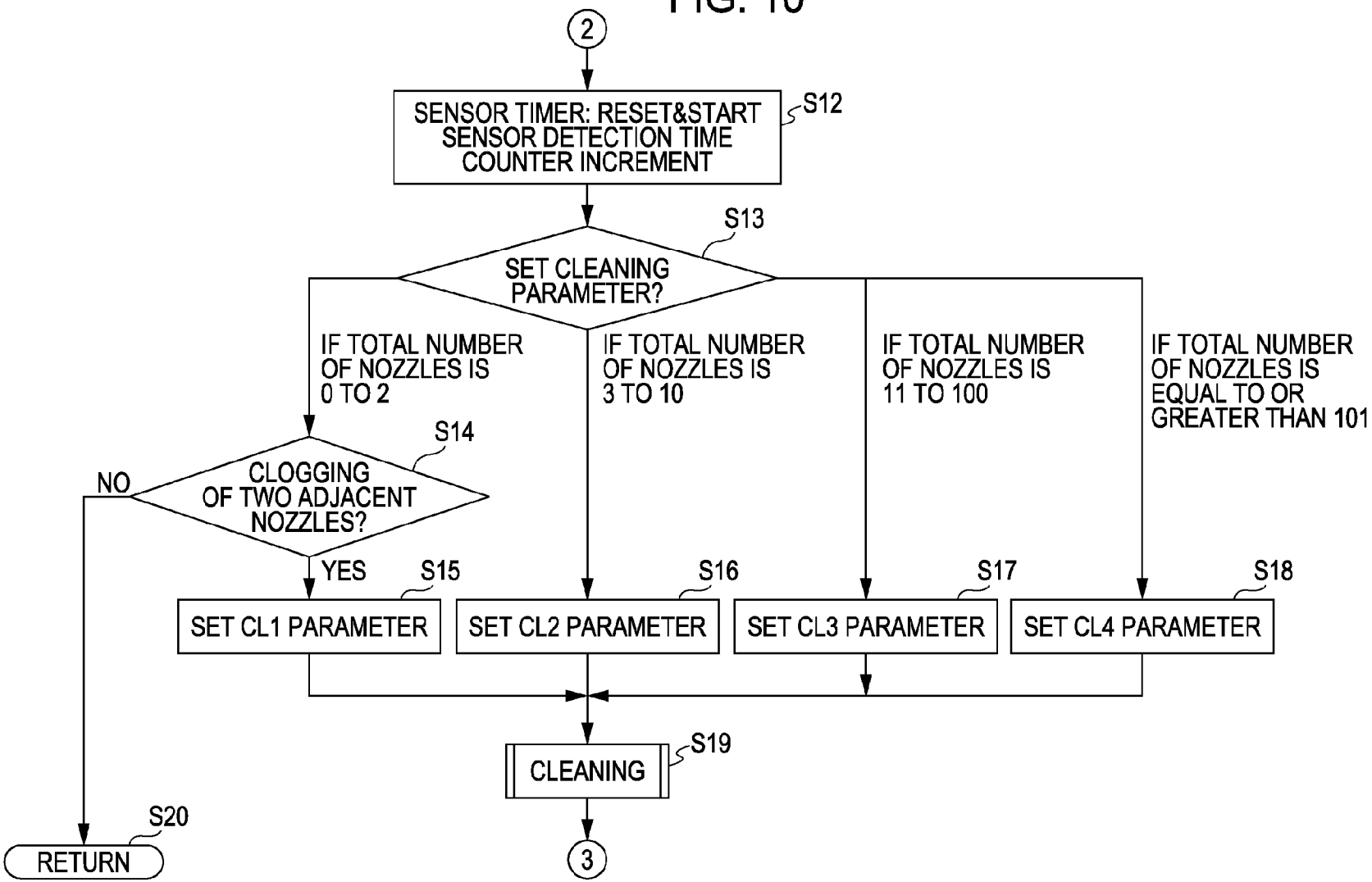
FIG. 10 is a view showing the cleaning process subsequent to FIG. 9.

Subsequently, a method of cleaning the printer 1 will be described as a method of cleaning a fluid ejecting apparatus of an embodiment of the invention with reference to the flowcharts of FIGS. 8 to 10.

The cleaning process of the printer 1 of the present embodiment is performed at the time of initial driving of the recording head 3, that is, when the power of the printer 1 is turned on, or before the printing process.

The cleaning process of the present embodiment includes a preliminary flushing step of performing a preliminary flushing operation for discharging the inks from the nozzles 47, a detecting step of detecting an ink ejection state of the nozzles 47 after the preliminary flushing step is finished, an inspecting step of determining the processing parameter at the time of cleaning of the recording head 3, and a cleaning step of cleaning the recording head 3 on the basis of the processing parameter.

Hereinafter, the cleaning process will be described in detail.

First, a process of preparing the cleaning process will be described with reference to FIG. 8. In the preparing process, the cap member 15 is lowered by an elevating/lowering mechanism (not shown), the recording head 3 is located above the cap member 15, the nozzle opening surface 43*a* of the recording head 3 and the electrode member 79 face each other in a non-contact state, and the ink droplet sensor 7 is in a standby state (step S1). If the ink droplet sensor 7 is not used, the printer 1 is continuously in a print processing state (step S2).

Subsequently, the control device 58 detects an elapsed time from a precedent preliminary flushing operation. At this time, if one week (1 W) or more is elapsed from the precedent preliminary flushing operation, a flushing step before printing is started (preliminary flushing step) is performed (steps S3 and S4). If the above time is not elapsed, no operation is performed.

If the preliminary flushing process is performed before the printing operation of the printer 1, as described above, the clogging of the plurality of nozzles may occur in the printer 1. In this case, before the inspecting step using the ink droplet sensor 7, the control device 58 performs the preliminary flushing operation so as to discharge the inks of amount corresponding to the volume of the common ink chamber 44 from the nozzles 47. At this time, the amount of inks is larger than that of a general flushing process. In order to discharge the large amount of inks, the duty at the time of discharge needs to be increased. Accordingly, by performing the preliminary flushing operation with the high duty, the clogging of nozzles due to bubbles can be caused. Thus, before the printing operation, the clogging of the plurality of nozzles may occur. If bubbles which cause the clogging of the plurality of nozzles during the printing process are included in the channel, the invention intends to cause the clogging of the nozzles before the printing process. The nozzles 47 which are not clogged may exist when the large amount of inks are discharged.

Subsequently, the temperature of the recording head 3 is detected by a thermistor (not shown) and temperature data is stored in the storage device 60 (step S5). The temperature of the recording head 3 has an influence on the viscosities of the inks discharged from the nozzles 47. Accordingly, the cleaning parameter is changed according to the viscosities of the inks. In more detail, in the present embodiment, as described above, the suction force of the suction pump 16 at the time of the suction operation is finely adjusted on the basis of the head temperature stored in the storage device 60.

Subsequently, the inspecting process of the ink droplet sensor 7 will be described with reference to the flowchart shown in FIG. 9. The flowchart shown in FIG. 9 corresponds to the inspecting step of detecting the ink ejection state of the nozzles 47 in the cleaning process.

First, a nozzle array counter (=1) is set (step S6). This nozzle array counter corresponds to the nozzle array of the recording head 3 and is increased (added by +1) as the inspection of each nozzle array is finished, as described below.

Next, the voltage is applied between the nozzle substrate 43 and the electrode member 79 by the voltage applying unit 75. That is, the ink droplet sensor 7 is turned on (step S7). At this time, for example, if the voltage is not suitably applied and a sensor failure is detected, the application of the voltage between the nozzle substrate 43 and the electrode member 79 is stopped (sensor OFF) and the general printing processing state is returned.

Meanwhile, if the voltage is suitably applied (the sensor failure is not detected), the inspection is performed by the ink droplet sensor 7 with respect to the nozzles 47 of each nozzle array (step S8). The inspection is performed as described with reference to FIG. 5. After the inspection of the nozzle array is finished, it is determined whether or not the nozzle array counter corresponds to the total number of nozzle arrays (8 arrays). If the nozzle array counter is less than 8, the nozzle array counter is increased (+1) (step S19) and the process returns to the step S16, in which the same inspection is performed with respect to the other nozzle arrays. Until the inspection is finished with respect to all the nozzle arrays, the steps S8 to S10 are repeated. After the inspection is finished with respect to all the nozzle arrays, the application of the voltage between the nozzle substrate 43 and the electrode member 79 is stopped (sensor OFF) (step S11).

By the above-described flowchart, the detecting step of detecting the ink discharge state of all the nozzles 47 formed in the nozzle substrate 43 is finished. At this time, data such as the number and the positions of defective nozzles is stored in the storage device 60 of the ink droplet sensor 7.

Subsequently, the parameter determining step of determining the parameter of the cleaning process on the basis of the detected result and the cleaning step of performing the cleaning process on the basis of the parameter will be described with reference to the flowchart shown in FIG. 10.

After the detecting step is finished, first, a timer of the ink droplet sensor 7 is reset and the timer is restarted (START). Then, a sensor detection time counter is increased (step S12). This sensor detection time counter is used to manage the number of times of start-up of the ink droplet sensor 7 and is increased one by one whenever the detecting step is performed.

Here, the setting of the cleaning parameter is performed. In more detail, in the present embodiment, as the cleaning parameter, the strength at the time of the suction operation is determined according to the number of clogged nozzles (defective nozzles) (step S13).

For example, if the number of clogged nozzles is 0 to 2 and the clogged nozzles are two adjacent nozzles, a first cleaning parameter CL1 is set (step S14 and step S15). The first cleaning parameter CL1 allows the suction pump 16 to be driven by the suction force with general strength. The ink meniscus of the nozzle opening is recovered or the inks in the vicinities of the nozzles are sucked and discharged such that remaining dust or the thickened inks of the nozzle opening can be eliminated. If the clogged nozzles are two nozzles which are not adjacent to each other, if the number of clogged nozzles is 1, and if the number of defective nozzles is zero, in the present embodiment, the clogged nozzles are allowed, the parameter determining step is not performed, the cleaning step is stopped, and the printing state is returned (step S20). Accordingly, since the printer 1 of the present embodiment is used for business purpose (for example, document preparation), the display quality is not largely damaged by one clogged nozzles or two clogged nozzles which are not adjacent to each other and no problem occur. Accordingly, according to the present embodiment, it is possible to prevent a problem in which the cleaning process is excessively performed such that no problem occurs in practical use. Since it is determined whether or not cleaning is performed by the cleaning parameter setting step, this step corresponds to the cleaning determining step of claims.

If the number of defective nozzles 3 to 10, a second cleaning parameter CL2 is set (step S16). This second cleaning parameter CL2 allows the suction pump 16 to be driven such that larger suction force is obtained compared with the first cleaning parameter CL1. Accordingly, it is possible to discharge inks thickened to the channel on the inner side of the vicinity of the nozzle opening.

If the preliminary flushing process is performed before the printing operation of the printer 1 which is in the standby state for a long period of time, as described above, the clogging of the plurality of nozzles may occur. In this case, at least 11 defective nozzles are detected.

Accordingly, in the present embodiment, if the number of defective nozzles 11 to 100, a third cleaning parameter CL3 is set (step S17). This third cleaning parameter CL3 corresponds to choke cleaning. In the choke cleaning, suction from the nozzles is performed by the suction pump in a state in which the upstream valve of the ink channel is closed (choke state). The bubbles expand by setting the interior of the recording head 3 to negative pressure, the valve is opened in this state, and the inks flow at a high flow rate such that the bubbles are discharged. For example, the bubbles adhered to the filter cannot pass through the filter by the suction force of the second cleaning parameter CL2. Accordingly, it is possible to discharge the bubbles by the choke cleaning with certainty.

In addition, in the present embodiment, if the number of defective nozzles is equal to or greater than 101, a fourth cleaning parameter CL4 is set (step S18). This fourth cleaning parameter CL4 corresponds a two-step choke cleaning of performing the choke cleaning by two steps.

In the present embodiment, the cleaning parameter is determined on the basis of the detected result of the detecting step of the ink droplet sensor 7. This cleaning parameter is stored in the storage device 60. In the present embodiment, since the recovery of the ink discharge characteristic of the recording head 3 is performed by one-time cleaning, the cleaning parameters CL1 to CL4 are set to a large amount of ink suction amount with respect to the number of defective nozzles.

In addition, the cleaning process is performed with respect to the recording head 3 (step S19). At this time, the control device 58 performs the cleaning operation on the basis of one of the cleaning parameters CL1 to CL4 stored in the storage device 60. In more detail, the control device 58 sets the suction force of the suction pump 16 according to the cleaning parameter and performs the suction operation.

Figure 8:
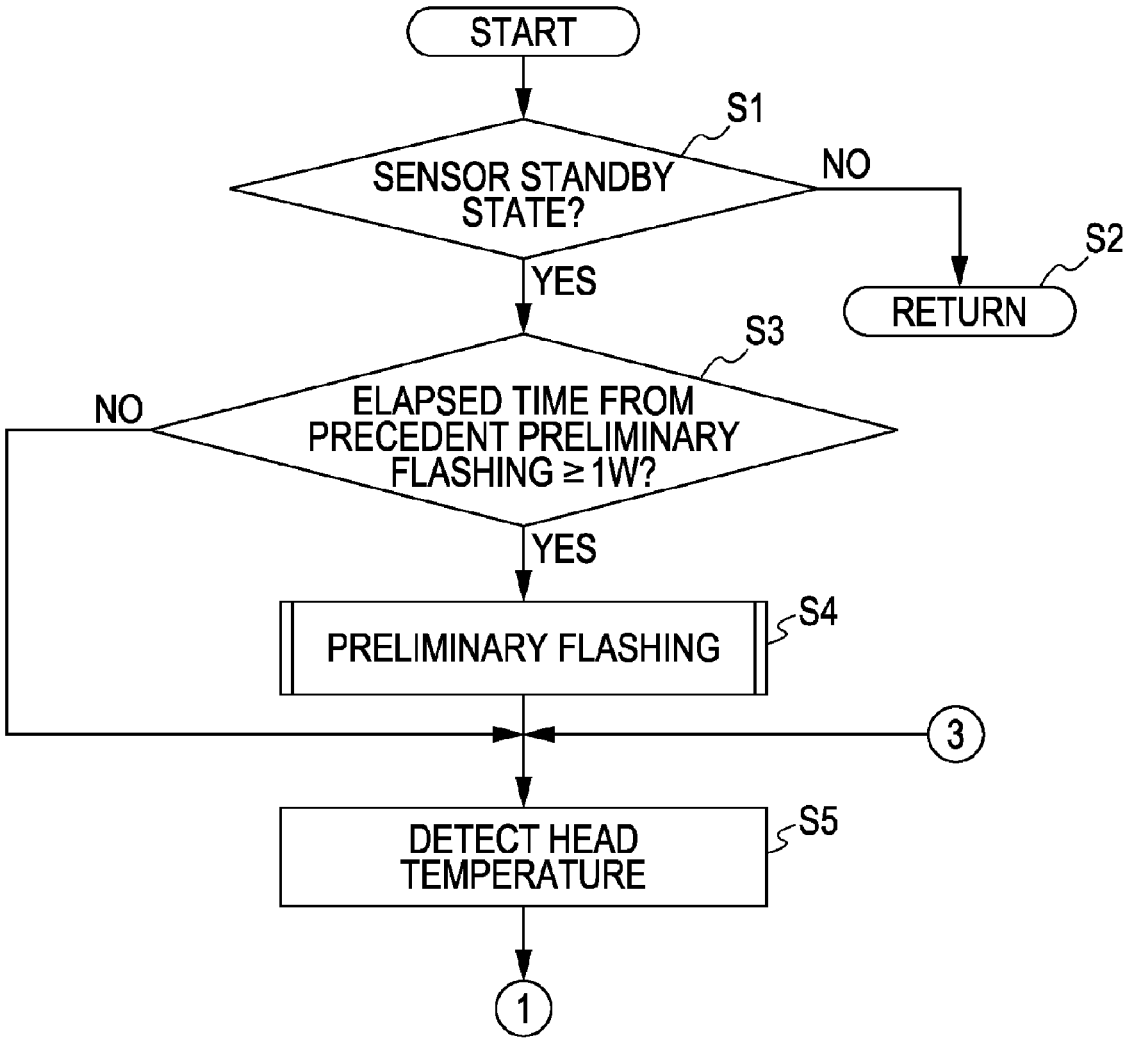
FIG. 8 is a flowchart showing a cleaning process.

In addition, as shown in FIG. 8, the process returns to the step S5.

In the present embodiment, in each cleaning process, after the cleaning step, the detecting step is performed again and the parameter determining step and the cleaning step are repeated according to the detected result. In more detail, if the defective nozzle is not detected when the inspecting step is performed after cleaning, the cleaning process is finished. If the cleaning process fails, the detecting step, the parameter determining step and the cleaning step are sequentially repeated. Accordingly, reliability is improved by determining whether or not the cleaning process fails. After the suction operation, a process of wiping the surface (that is, the nozzle opening surface 43*a*) of the nozzle substrate 43 may be performed.

Accordingly, according to the printer 1 of the present embodiment, if the clogging of the plurality of nozzles occurs by the preliminary flushing process, an excellent cleaning process is performed on the basis of the cleaning parameters CL3 and CL4 and the discharge characteristic of the recording head 3 is recovered. Accordingly, when the printing process is performed by the printer 1 in which the nozzles which are clogged in advance before the printing process are cleaned, the clogging of the plurality of nozzles does not occur during printing and a reliable printer can be provided for business purpose.

Although, in the above-described embodiment, various suitable examples of the invention are described, the invention is not limited to the embodiment and may be modified without departing from the scope of the invention.

Although, for example, in the above-described embodiment, the ink droplet sensor 7 is used in the detecting step of detecting the ink discharge state of the nozzles 47, the invention is not limited to the ink droplet sensor. For example, any unit for detecting the ink discharge state of the nozzles 47 in a short time may be used. In more detail, a unit for irradiating laser light to the discharged inks and detecting whether the inks are discharged by the light-receiving state of a light-receiving device may be used.

Although, in the above-described embodiment, the ink jet printer (recording apparatus) is implemented as the liquid ejecting apparatus, the invention is not limited to the ink jet printer and a fluid ejecting apparatus for ejecting or discharging other liquids (a liquid in which particles of a functional material are dispersed or a fluid such as gel) except the ink may be implemented.

For example, a liquid ejecting apparatus for ejecting a liquid including a material, such as an electrode material or a coloring material, used for manufacturing a liquid crystal display, an electroluminescence (EL) display, a field emission display; a liquid ejecting apparatus for ejecting a bio organic matter used for manufacturing biochips; and a liquid ejecting apparatus for ejecting a liquid which is a sample as a precision pipette.

In addition, a liquid ejecting apparatus for ejecting lubricating oil to a precision machinery such as clocks or cameras by a pinpoint; a liquid ejecting apparatus for ejecting a transparent resin solution such as ultraviolet curing resin onto a substrate in order to form a minute semispherical lens (optical lens) used for an optical communication element; a liquid ejecting apparatus for ejecting an etchant such as acid or alkali in order to etch substrates; a fluid ejecting apparatus for ejecting gel or the like may be employed.

The invention is applicable to any one of the above-described liquid ejecting apparatuses if the ejected liquid (liquid or fluid) may be, for example, dried and thickened such that a discharge failure occurs.

The entire disclosure of Japanese Patent Application Nos. 2007-319751, filed Dec. 11, 2007, 2008-262660, filed Oct. 9, 2008, are expressly incorporated by reference herein.

What is claimed is:

1. A method of cleaning a fluid ejecting apparatus including an ejection head including a plurality of ejection nozzles for ejecting a fluid to a target and a common fluid chamber from which the fluid is supplied to the ejection nozzles, the method comprising:

performing a preliminary discharge operation for discharging the fluid from the ejection nozzles before the fluid is ejected to the target;

detecting a fluid ejection state of the ejection nozzles after the preliminary discharge operation is finished;

determining a processing parameter at the time of cleaning of the ejection head on the basis of the detected result; and performing cleaning with respect to the ejection heads on the basis of the processing parameter, wherein, in the performing of the preliminary discharge operation, the fluid of the amount corresponding to at least the volume of the common fluid chamber is ejected, wherein the preliminary discharge operation is performed without detecting the fluid ejection state of the ejection nozzles and wherein the preliminary discharge operation is performed when a predetermined time from a precedent preliminary discharge operation is elapsed.

2. The method according to claim 1, wherein the detecting of the fluid ejection state includes detecting defective nozzles for causing a fluid ejection failure and the determining of the parameter includes determining the parameter on the basis of the number of defective nozzles.

3. The method according to claim 1, further comprising determining whether or not the cleaning of the ejection head is performed on the basis of the detected result, between the detecting of the fluid ejection state and the determining of the parameter.

4. The method according to claim 1, wherein, in the detecting of the fluid ejection state, a voltage is applied between a nozzle opening surface of the ejection head in which the ejection nozzles are formed and a fluid reception portion which faces the nozzle opening surface in a non-contact state, the fluid is ejected from the ejection nozzles to the fluid reception portion, and a nozzle ejection state is detected by a voltage variation based on electrostatic induction when the fluid is ejected to the fluid reception portion.

5. A fluid ejecting apparatus including an ejection head including a plurality of ejection nozzles for ejecting a fluid to a target and a common fluid chamber from which the fluid is supplied to the ejection nozzles, the fluid ejecting apparatus comprising:

a discharge device which causes the ejection head to perform a preliminary discharge operation for discharging the fluid from the ejection nozzles before the fluid is ejected to the target;

a fluid detection unit which detects a fluid ejection state of the ejection nozzles after the preliminary discharge operation is finished and determines a processing parameter when cleaning is performed with respect to the ejection head on the basis of the detected result; and a control device which is electrically connected to the discharge device and the fluid detection unit and performs cleaning with respect to the ejection head on the basis of the processing parameter, wherein the control device controls the preliminary discharge operation performed by the discharge device such that the fluid of the amount corresponding to at least the volume of the common fluid chamber is ejected, wherein the preliminary discharge operation is performed without detecting the fluid ejection state of the ejection nozzles and wherein the preliminary discharge operation is performed when a predetermined time from a precedent preliminary discharge operation is elapsed.

* * * * *